US006420972B1

(12) United States Patent
Loose

(10) Patent No.: US 6,420,972 B1
(45) Date of Patent: Jul. 16, 2002

(54) DOOR MONITOR FOR A GAMING MACHINE

(75) Inventor: Timothy C. Loose, Chicago, IL (US)

(73) Assignee: WMS Gaming, Inc., Chicago, IL (US)

( * ) Notice: Subject to any disclaimer, the term of this patent is extended or adjusted under 35 U.S.C. 154(b) by 0 days.

(21) Appl. No.: 09/691,516

(22) Filed: Oct. 18, 2000

(51) Int. Cl.[7] ..... G08B 13/08

(52) U.S. Cl. ..... 340/545.1; 273/143 R; 219/721; 219/722

(58) Field of Search ..... 340/545.1, 545.2, 340/545.3, 545.4, 545.6, 545.9, 571; 273/143 R; 219/721, 722

(56) References Cited

U.S. PATENT DOCUMENTS 4,556,773 A * 12/1985 Yoshiyuki et al. ..... 219/723
4,596,411 A * 6/1986 Geringer et al. ..... 292/165
4,795,155 A * 1/1989 Grande ..... 273/143 R
5,224,707 A * 7/1993 Martin ..... 273/143 R
5,616,270 A * 4/1997 Park ..... 219/722
5,890,439 A * 4/1999 McGunn ..... 109/47
6,066,038 A * 5/2000 Sciortino et al. ..... 453/17

* cited by examiner

*Primary Examiner*—John Tweel
(74) *Attorney, Agent, or Firm*—Jenkens & Gilchrist

(57) ABSTRACT

A door-monitoring system comprises a power supply electrically connected to an oscillator. The oscillator sends a signal to a junction between a switch to ground and a latch circuit. When the switch to ground is open, current flows from the oscillator to a set input on the latch, thus indicating that connections in the vicinity of the switch have been broken or the door has been opened. A microprocessor is adapted to receive output from the latch circuit and respond appropriately to an indication that the connections have been broken or the door has been opened.

8 Claims, 4 Drawing Sheets

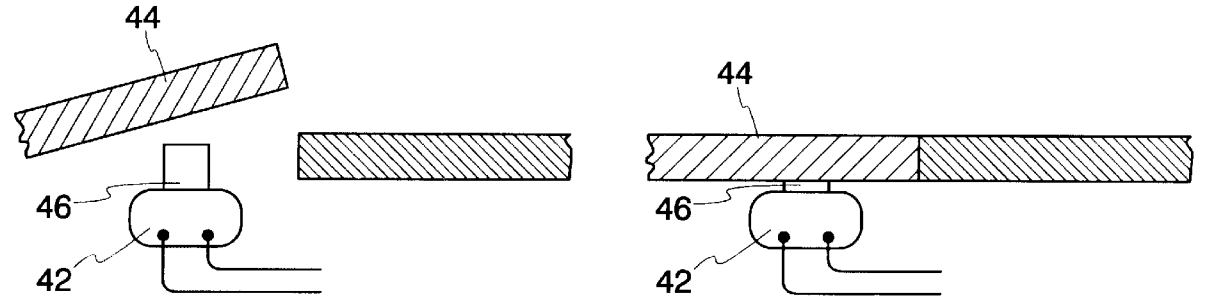
Fig. 3a
Fig. 3b
| S | R | Q | $\overline{Q}$ |
|---|---|---|---|
| 0 | 0 | Q | $\overline{Q}$ |
| 1 | 0 | 1 | 0 |
| 0 | 1 | 0 | 1 |
| 1 | 1 | 0 | 0 |
Fig. 4b
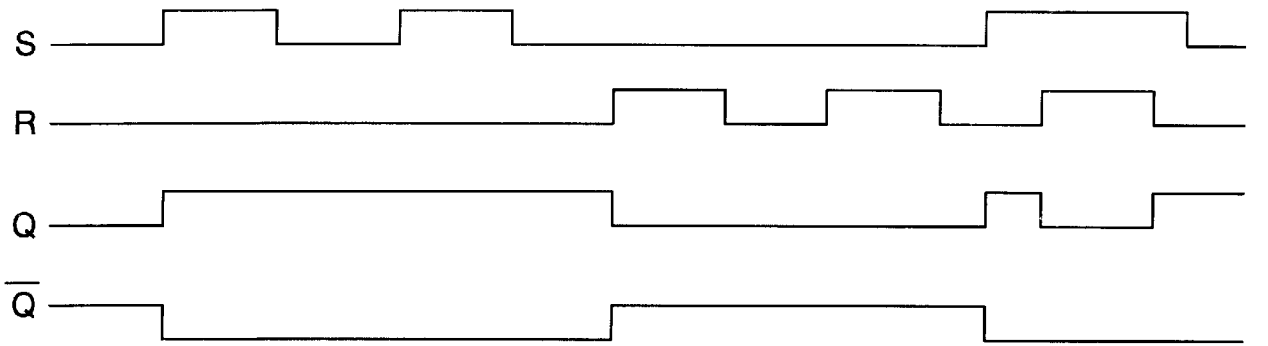
Fig. 4a

DOOR MONITOR FOR A GAMING MACHINE

FIELD OF THE INVENTION

The present invention generally relates to gaming machines and more generally relates to a door-monitoring security alert for a gaming machine.

BACKGROUND OF THE INVENTION

Casino operators rely on a variety of systems for maintaining casino security. Where gaming machines, such as slot machines, poker or other card game machines, keno machines, and the like are used, the machines themselves often contain various security measures to prevent casino guests and employees from tampering with or stealing from the gaming machines, and to alert casino operators when tampering or theft may have occurred.

Gaming machines have a variety of door types, which allow access to the machine to collect coins, make repairs, perform evaluations and updates, and so forth. One type of security measure alerts casino operators or disables gaming machines when the doors of machines have been opened. Some such devices run on power from the gaming machine, and if that power is interrupted or turned off, tampering or theft may go undetected. In addition, it is possible to tamper with some existing door monitor devices by opening the door, disabling the monitor, and then closing the door. With such a device, it is possible to open the door during a routine coin collection or machine evaluation and disable the monitor so that the door can be opened later to allow theft or tampering with the machine.

Door-monitoring devices often employ switches and electronic "latches" which indicate whether the switches have been activated. An electronic latch is a circuit which, having received one set of inputs, will continually give one predefined output until enacted upon by a "reset" set of inputs. In a door-monitoring application, for example, such a circuit will continue to show that a door has been opened or disable a machine after the door has been opened and then closed.

One type of prior art door-monitoring device 1 is shown in FIG. 1. In this prior art device, a battery 2 is electrically connected through a resistor 12 to the "inverted-set" or "S-bar" input 6 of an electronic set/reset latch ("S/R latch") 8. The prior art device has a connection 10 through a switch 4 to ground 14 between the resistor 12 and the S-bar input 6 of the S/R latch 8. The S/R latch 8 further contains an "inverted-reset" or "R-bar" input 16 coupled to a game microprocessor 22, and a "Q" output 20 to the game microprocessor 22. The S/R latch 8 is powered by a latch power supply 24, which may be the battery 2.

The prior art door-monitoring device 1 is designed so that the switch 4 is open when a door to be monitored is closed. When the door to be monitored is opened, the switch 4 closes, and current flows from the battery 2, through the resistor 12 and through the switch 4 to ground 14. This pulls the S-bar input 6 low, activating it. This gives an output signal at the Q output 20, informing the game microprocessor 22 that the door has been opened. This output from the Q output will continue until the door is closed and the R-bar input 16 is activated. In a normal situation where a door would be opened, such as during machine maintenance or during collection from a gaming machine, the door would be closed afterward and the reset input 16 would be activated, thereby informing the game microprocessor 22 that the door has been properly closed. The R-bar input 16 may itself be activated (i.e., given a "0" input) by the game microprocessor 22 as shown in FIG. 1.

The design of the prior art door-monitoring device 1 has a fault, in that if the connections 24 in the vicinity of the switch 4 are accidentally or intentionally broken at any point, the S-bar input 6 will always stay high and thus the S/R latch 8 will indicate that the door has been closed. Thus, when the R-bar input 16 is activated by the microprocessor 22 following the breaking of the connection 24, the microprocessor 22 will receive a signal indicating that the door has been properly closed, even if the door is opened and closed a number of times following the breaking of the connection 24. This design allows for a scenario wherein a gaming machine door is legitimately opened, with the connection 24 being broken while the door is opened. Once the R-bar input 16 is activated thereafter, unscrupulous persons could open and close the door at will to access coins or the inner workings of the gaming machine without the microprocessor 22 being automatically informed.

There exists a need for a door monitor for gaming machines which will continuously operate independent of the gaming machine power supply and which prevents the problem of tampering with the monitor while a gaming machine door is opened.

SUMMARY OF THE INVENTION

The present invention comprises a method and system for monitoring game machine doors which discloses when a door has been opened or when the door monitor has been tampered with.

A door-monitoring method and system according to the present invention uses a small amount of power and is capable of operating independent of a gaming machine power supply.

According to one embodiment of the present invention, a normally-closed switch is used to indicate whether a door is open or closed. Utilizing such a switch, the switch is closed when the door is closed, and thus a circuit is completed. When the door is opened, the switch is opened and the circuit is broken, triggering an electronic latch output which indicates that the door has been opened. When the door is later closed, thereby closing the switch, the electronic latch output continues to indicate that the door has been opened until its reset input is activated. In one variation of this embodiment, the electronic latch output is coupled to a game controller and the game is disabled when the door has been opened or the monitor has been tampered with.

In one embodiment of the present invention, a door-monitoring signal is provided by a battery connected to an oscillator, which is then connected via a normally-closed switch to ground. In this embodiment, the oscillator assures that power from the battery is not dissipated quickly, but rather is capable of being used to produce a signal for an extended period of time. In one variation of this embodiment, one battery may be used to produce a signal for a year or more.

BRIEF DESCRIPTION OF THE DRAWINGS

These and other advantages of the invention will become apparent upon reading the following detailed description and upon reference to the drawings in which:

FIGS. 3*a* and 3*b* are demonstrative drawings of a door monitor switch for use with the present invention;

FIGS. 4*a* and 4*b* show the logical operation of an electronic latch used in an embodiment of the present invention;

Figure 1:
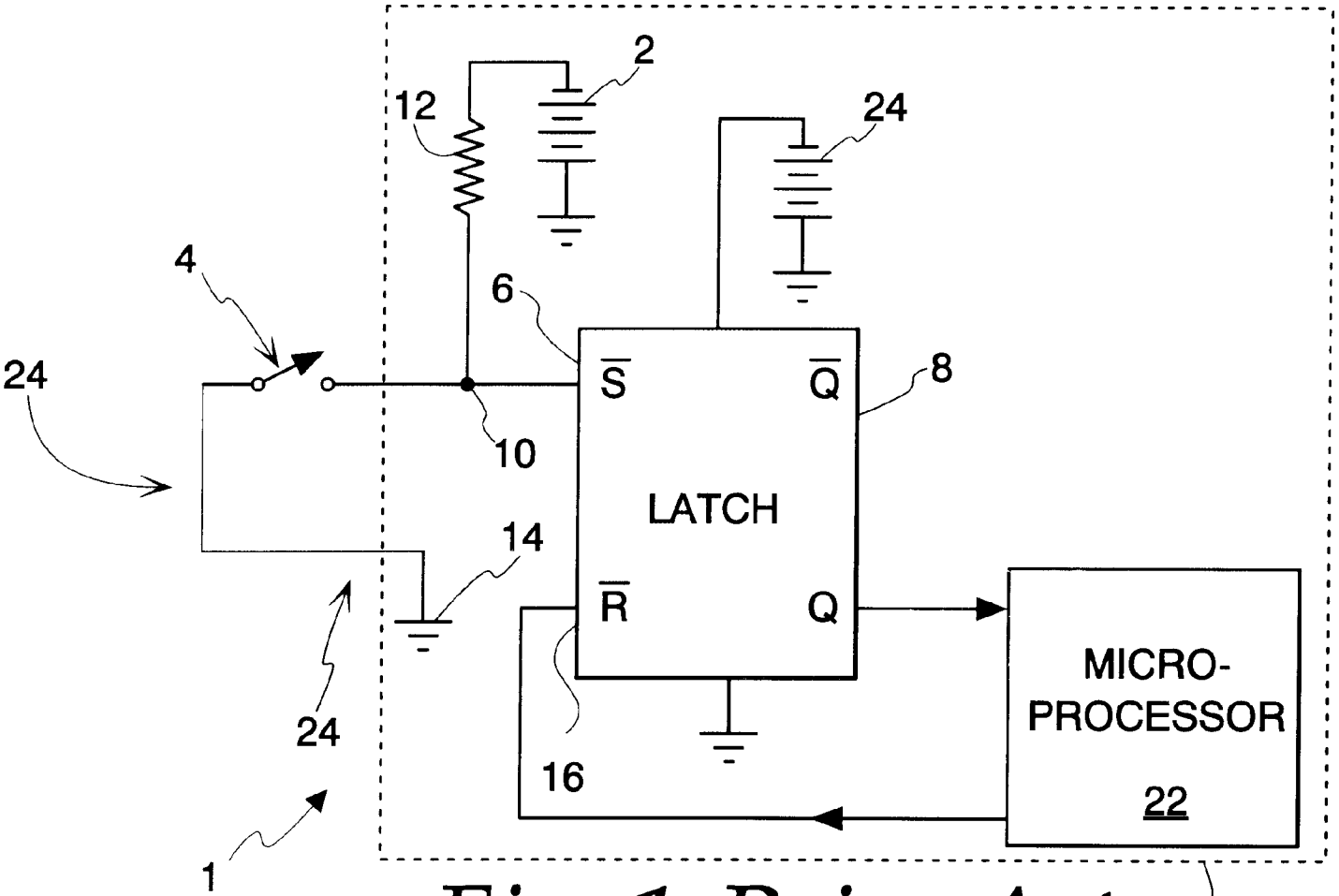
Fig. 1 Prior Art
FIG. 1 is a circuit diagram of a prior art door monitor circuit.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Figure 2:
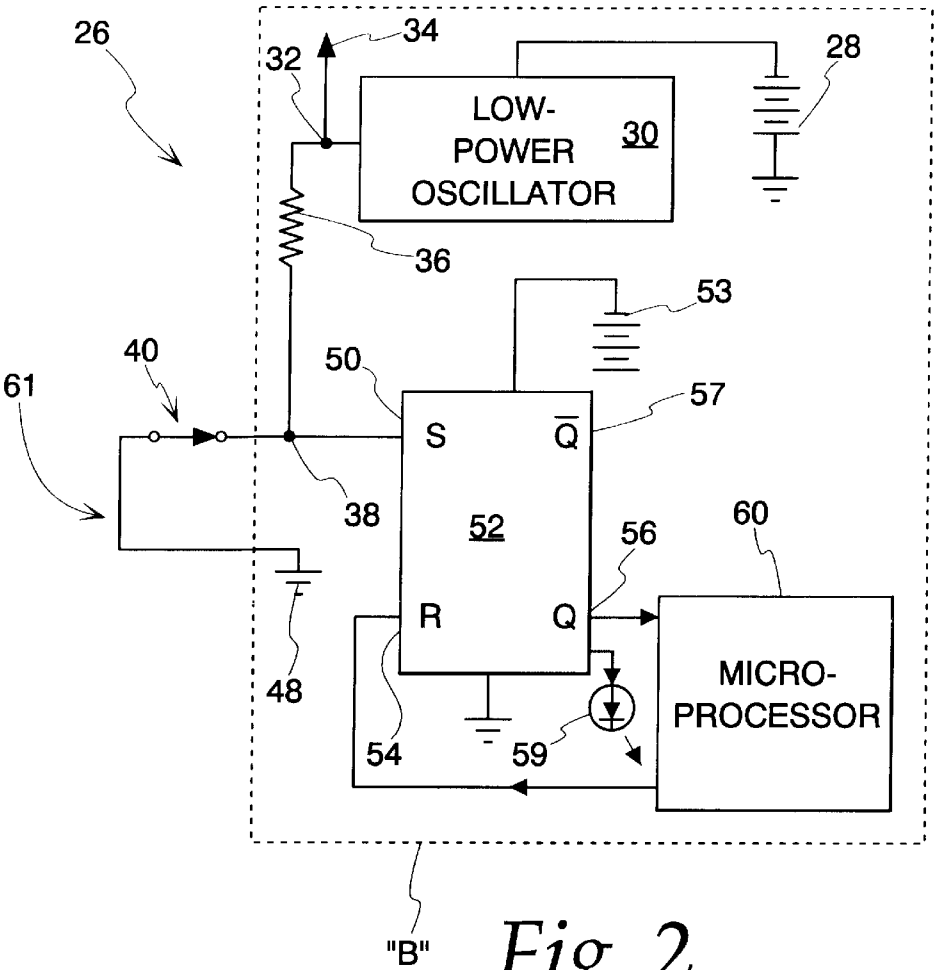
FIG. 2 is a circuit diagram of a door monitor circuit according to one embodiment of the present invention.

FIG. 2 shows a circuit diagram for a door monitor system 26 of the present invention, which provides increased security for gaming machines. A door-monitoring system 26 according to the present invention has a door monitor battery 28 electrically connected to a low power oscillator 30. The low power oscillator 30 drains the door monitor battery 28 at a slow rate, and is preferentially provided with a low duty cycle. For example, the low power oscillator 30 may emit pulses with a width of approximately 250 $\mu$s at a period of approximately 100 ms. The duty cycle of the low power oscillator is the pulse width divided by the period, and in this embodiment would be approximately 0.0025. A range of duty cycles can be used with the present invention. Duty cycles from approximately 0.0005 to approximately 0.005, for example, are effective for use with several embodiments of the present invention. These low duty cycles greatly reduce the effective power available at the output of the oscillator, which is the key to limiting the power dissipation from the door monitor battery 28. The maximum duty cycle is limited by the allowable power dissipation available from the battery, while noise and interference effects limit the minimum duty cycle. The battery voltage must be chosen to be compatible with the input requirements of a latch circuit 52. In-one embodiment, the output of the oscillator 30 flows to a junction 32. Here, the output is split and part of the output flows down the alternate door monitor pathway 34 to another door monitor circuit. The remaining output flows through a resistor 36 having a resistance of from approximately 100 Kohms to approximately 1 Megohms before reaching a switch junction 38. From here, the flow of the output from the oscillator 30 depends on the status of the door switch 40, which is preferably a pressure switch 42 that is automatically activated when a gaming machine door 44 is opened or closed, as shown in FIGS. 3*a* and 3*b*.

The wiring between the oscillator 30 and the latch circuit 52, contained within dotted line box "B" in FIG. 2, may in one embodiment be printed on one circuit board, with wiring to the door switch being the only accessible wiring outside of a circuit board compartment within a gaming machine.

FIG. 3*a* shows the status of a door-monitoring pressure switch 42 when a gaming machine door 44 is open. The pressure switch 42 comprises a switch activator 46, which is in an extended position when the door 44 is open. As shown in FIG. 3*b*, when the door 44 is closed, the switch activator 46 is depressed. Other styles of switch may be used such that the switch 40 is necessarily closed when the door 44 is in its closed position and necessarily open when the door 44 is opened.

In one embodiment of the present invention, the pressure switch 42 is open when the switch activator 46 is in its extended position corresponding to the door 44 being open. In this embodiment, when the door switch 40 is closed, current flows from the oscillator 30 through the resistor 36 to ground 48 rather than to an "S" input 50 on a latch circuit 52. The latch circuit 52 is connected to a power source 53, which may be the door monitor power supply 28. The significance of the current flow through the switch 40 can be more thoroughly understood by examining the logic of a latch circuit 52 as shown in FIGS. 4*a* and 4*b*.

FIG. 4*a* shows the logical behavior of a latch circuit 52 created with cross-coupled logical NOR gates as is known in the art. A latch circuit 52 for use with the present invention includes at least two logical inputs and one or more logical outputs. The logical inputs of a latch circuit for use with the present invention include the set or "S" input 50 and the reset or "R" input 54. The logical outputs include at least a first logic or "Q" output 56 and optionally include a second, inverted logic or "Q-bar" output 58. FIG. 4*a* shows lines extending from the S and R inputs and the Q and Q-bar outputs corresponding to their logical behavior. A line moving from high to low represents a move from a logical 1 to a logical 0, and a line moving from low to high represents a move from a logical 0 to a logical 1. As shown in FIG. 4*a*, a latch circuit 52 created with cross-coupled NOR gates gives a positive or "logical 1" at the Q output 56 when current sufficient to create a logical 1 input flows to the S input 50, so long as a logical 0 is being input to the R input 54. This logical 1 at the Q output 56 continues even if the S input 50 reverts to a logical 0, and will only revert to a logical 0 output if the R input 54 is changed to a logical 1 (i.e., when a reset switch is activated or when a reset signal is sent from a game microprocessor 60). To avoid malfunctioning of the latch circuit 52, it is pre-set so that logical 1 inputs at the S input 50 and R input 54 result in logical 0 outputs at both the Q output 56 and the Q-bar output 58. Otherwise, the Q-bar output 58 always gives the logical inverse of the Q output 56. This is further illustrated in FIG. 4*b*, which is a truth table showing this logical behavior.

The logical behavior of the latch circuit 52 as used in the door-monitoring system 26 allows casino operators to be informed when a gaming machine door 44 has been opened or when the system 26 has been tampered with. In the preferred embodiment, when the gaming machine door 44 is closed, the door switch 40 is closed. When the door switch 40 is closed, current from the oscillator 30 is directed to ground 48 and thus the S input 50 remains at a logical 0. When the door is opened, the current from the oscillator 30 passes through the switch junction to the S input 50, thereby setting the Q output 56 of the latch to a logical 1, as described above. This logical 1 output proceeds to a game microprocessor 60.

Figure 5:
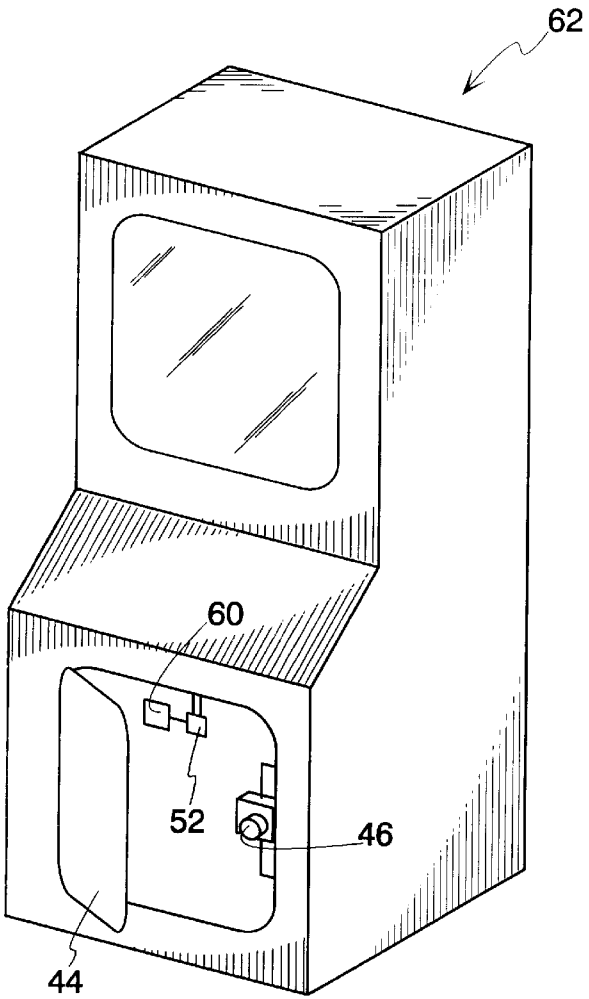
FIG. 5 is a perspective drawing of a gaming machine for use with the present invention.

The game microprocessor 60 carries out and delivers instructions dealing with the play, display, and other operations of a gaming machine 62 as shown in FIG. 5. The game microprocessor 60 may react to the logical 1 output in a number of ways. For example, the game microprocessor 60 may disable the game while a logical 1 exists at the Q output 56, or it may activate an indicator to inform a casino operator that the machine door 44 has been opened.

This embodiment of a door-monitoring system 26 has the advantage of proceeding to give a logical 1 input at the S input 50 even if the connections 61 in the vicinity of the door switch 40 are tampered with. Because any loss of connection in the vicinity of the door switch 40 will be the equivalent of the door switch 40 being open, current from the oscillator 30 will continue to flow to the S input 50, thereby indicating that the door 44 is "open" and providing a logical 1 output at the Q output 56. Thus, anyone who believes he or she is disabling the door switch 40 by cutting the connections 61 will actually be perpetuating a signal that the door 44 is open, prompting service or other action by casino operators or security personnel.

The total power consumed by one embodiment of the door-monitoring system of the present invention adapted to monitor eight doors is approximately 50 $\mu$W.

In one embodiment of the present invention, the latch circuit 52 may be comprised of cross-coupled NAND gates as known in the art. In such a circuit, inverters could be provided at the S input 50 and the R input 54 to preserve the behavior of the circuit for use with the present invention. The microprocessor 60 may also be programmed to react differently to outputs, and may be connected to either the Q output 56 or the Q-bar output 57 of the latch circuit 52. The Q output 56 may be connected a light-emitting diode 59 to visually show the status of the Q output.

Figure 6:
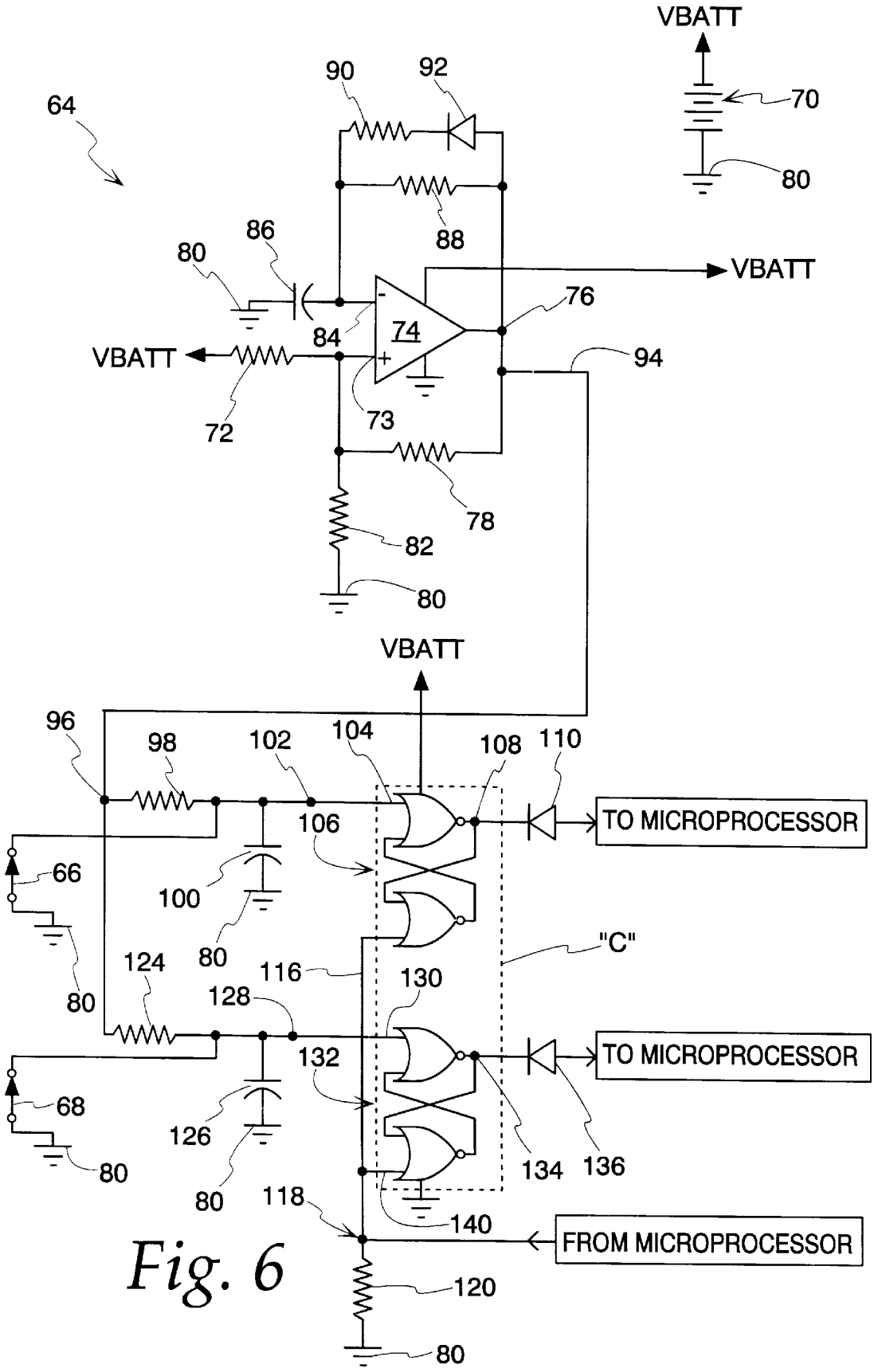
FIG. 6 is a circuit diagram of a door monitor circuit according to one embodiment of the present invention.

Turning now to FIG. 6, a circuit diagram for a two-door-monitoring system 64 according to one embodiment of the present invention is shown. The system 64 is adapted to monitor two door switches, a first door switch 66 and a second door switch 68. It will be understood that the monitoring system 64 can be scaled upward to monitor more than two doors or downward to monitor only one door. In FIG. 6, connections to "VBATT" represent connections to a battery 70.

The monitoring system 64 is powered by a monitoring system battery 70. The active element is a low power comparator circuit 74. In one embodiment, the low power comparator is a Maxim MAX917 integrated circuit. The battery 70 is connected through a power input resistor 72 to the "+" input 73 of the low power comparator 74. In one embodiment, the power input resistor 72 has a resistance of approximately 4.7 MΩ. The "+" input 73 of the low power comparator 74 and the output 76 of the low power comparator 74 are connected in parallel with a first oscillator resistor 78. In one embodiment, the first oscillator resistor 78 has a resistance of approximately 4.7 MΩ. The connection between the "+" input 73 of the low power comparator 74 and the output 76 of the low power comparator 74 is connected to ground 80 through a first oscillator grounding resistor 82. In one embodiment, the first oscillator grounding resistor 82 has a resistance of approximately 4.7 MΩ.

The "−" input 84 of the low power comparator 74 is connected through an oscillator grounding capacitor 86 to ground 80. In one embodiment, the oscillator grounding capacitor 86 has a capacitance of approximately 0.3 $\mu$f. The "−" input 84 of the low power comparator 74 is further connected through a second oscillator resistor 88 to the output 76 of the low power comparator 74. The connection through the second oscillator resistor 88 is in parallel with a connection through a third oscillator resistor 90 and an oscillator diode 92. In one embodiment, the second oscillator resistor 88 has a resistance of approximately 4.7 MΩ, the third oscillator resistor 90 has a resistance of approximately 10 kΩ, and the oscillator diode 92 is an "IN4148" diode.

The output 76 is connected through an oscillator test point 94 to a branching juncture 96. In the two-door embodiment 64, one branch serves to monitor a first door switch 66 and a second branch serves to monitor a second door switch 68. In the first branch, the branching juncture 96 is connected through a first switch resistor 98 past a first switch capacitor 100 to ground 80, further past the first door switch 66 to ground 80, further past a first door switch test point 102 to a set input 104 of a first door-monitoring latch circuit 106. In one embodiment, the first switch resistor 98 has a resistance of approximately 100 kΩ, the first switch capacitor 100 has a capacitance of approximately 470 pf, and the first door-monitoring latch circuit 106 is comprised of two cross-coupled 74HCO2 NOR gates and is connected to a battery power supply 70.

The "inverted-Q" or "Q-bar" output 108 of the first door-monitoring latch circuit 106 is connected through a first door switch isolation diode 110 and to the microprocessor.

The R input 116 of the first door-monitoring latch circuit 106 is connected to a reset juncture 118. The reset juncture is connected through a reset resistor 120 to ground 80 and is further connected to the microprocessor.

In the second branch from the branching juncture 96, the branching juncture 96 is connected through a second switch resistor 124 past a second switch capacitor 126 to ground 80, further past the second door switch 68 to ground 80, further past a second door switch test point 128 to a set input 130 of a second door-monitoring latch circuit 132. In one embodiment, the second switch resistor 124 has a resistance of approximately 100 kΩ, the second switch capacitor 126 has a capacitance of approximately 470 pf, and the second door-monitoring latch circuit 132 is comprised of two cross-coupled 74HCO2 NOR gates and is connected to a battery power supply 70. The latch circuits 106 and 132 may be printed on one circuit board as shown by the dotted box "C."

The Q-bar output 134 of the second door-monitoring latch circuit 132 is connected through a second door switch isolation diode 136 and further through a second door switch output resistor 138 to the juncture 114. In one embodiment, the second door switch output resistor 138 has a resistance of approximately 1 kΩ. The R input 140 of the first door-monitoring latch circuit 106 is connected to the reset juncture 118.

While the present invention has been described with reference to one or more particular embodiments, those skilled in the art will recognize that many changes may be made thereto without departing from the spirit and scope of the present invention. Each of these alternative embodiments and obvious variations thereof is contemplated as falling within the spirit and scope of the claimed invention, which is set forth in the following claims.

What is claimed is:

1. A door-monitoring system for a gaming device, said system comprising:

a battery powering a low-power oscillator, said low power oscillator being coupled to an S (set) input of an S/R latch;

a switch connected to ground at a first end and electrically coupled between said oscillator and said S input at a second end, said switch being switched by a door on said gaming device such that the switch is open when the door is open; and a reset switch coupled to an R (reset) input of the S/R latch.

2. The door-monitoring system of claim 1 wherein said low-power oscillator has a pulse width of approximately 250 $\mu$s and a period of approximately 100 ms.

3. The door-monitoring system of claim 1 wherein a Q output of the S/R latch is coupled to a game microprocessor.

4. The door-monitoring system of claim 3 wherein the game microprocessor is adapted to disable the gaming device if the Q output of the S/R latch indicates that the door has been opened.

5. The door-monitoring system of claim 1 wherein a Q output of the S/R latch is coupled to a light emitting diode and provides current sufficient to activate the light emitting diode.

6. A method for monitoring one or more doors in a gaming device comprising:

providing a battery adapted for powering a low-power oscillator;

providing an electrical connection between the low-power oscillator and one or more S (set) inputs of S/R latch circuits;

providing a switch on every door to be monitored, the switch being connected between the electrical connection to the S inputs and ground; and monitoring one or more doors via Q outputs from the latch circuits.

7. The method of claim 6 wherein the Q outputs are electrically connected to a gaming device microprocessor.

8. The method of claim 6 wherein the Q outputs are electrically connected to light emitting diodes and are adapted to provide sufficient current to activate the light emitting diodes.

* * * * *